US010472585B2

(12) United States Patent
Mochizuki et al.

(10) Patent No.: US 10,472,585 B2
(45) Date of Patent: Nov. 12, 2019

(54) AQUEOUS LUBRICANT FOR PLASTIC WORKING OF METAL MATERIAL AND HAVING SUPERIOR GAS CLOGGING RESISTANCE AND POST-MOISTURE ABSORPTION WORKABILITY

(71) Applicant: Nihon Parkerizing Co., Ltd., Tokyo (JP)

(72) Inventors: Masaru Mochizuki, Tokyo (JP); Manabu Kumagai, Tokyo (JP); Yuta Kobayashi, Tokyo (JP)

(73) Assignee: NIHON PARKERIZING CO., LTD., Tokyo (JP)

( * ) Notice: Subject to any disclaimer, the term of this patent is extended or adjusted under 35 U.S.C. 154(b) by 720 days.

(21) Appl. No.: 14/903,785

(22) PCT Filed: Jun. 27, 2014

(86) PCT No.: PCT/JP2014/067173
§ 371 (c)(1),
(2) Date: Jan. 8, 2016

(87) PCT Pub. No.: WO2015/005142
PCT Pub. Date: Jan. 15, 2015

(65) Prior Publication Data

US 2016/0160150 A1 Jun. 9, 2016

(30) Foreign Application Priority Data

Jul. 10, 2013 (JP) ..... 2013-144950

(51) Int. Cl.

| | |
|---|---|
| ***C10M 171/00*** | (2006.01) |
| ***C10M 107/04*** | (2006.01) |
| ***C10M 125/10*** | (2006.01) |
| ***C10M 125/24*** | (2006.01) |
| ***C10M 137/04*** | (2006.01) |
| ***C10M 145/12*** | (2006.01) |
| ***C10M 145/24*** | (2006.01) |
| ***C10M 177/00*** | (2006.01) |
| ***C10M 169/04*** | (2006.01) |
| ***C10M 125/26*** | (2006.01) |
| ***C10M 145/26*** | (2006.01) |
| ***C10M 149/06*** | (2006.01) |
| ***C10M 149/10*** | (2006.01) |
| ***C10M 149/18*** | (2006.01) |

(52) U.S. Cl.
CPC ..... *C10M 169/044* (2013.01); *C10M 107/04* (2013.01); *C10M 125/10* (2013.01); *C10M 125/24* (2013.01); *C10M 125/26* (2013.01); *C10M 137/04* (2013.01); *C10M 145/12* (2013.01); *C10M 145/26* (2013.01); *C10M 149/06* (2013.01); *C10M 149/10* (2013.01); *C10M 149/18* (2013.01)

(58) Field of Classification Search
CPC ..... C10M 171/00
See application file for complete search history.

(56) References Cited

U.S. PATENT DOCUMENTS

| | | | | |
|---|---|---|---|---|
| 5,368,757 | A * | 11/1994 | King | C10M 107/20 508/232 |
| 6,455,476 | B1 | 9/2002 | Imai et al. | |
| 7,414,012 | B2 | 8/2008 | Imai et al. | |
| 2010/0003529 | A1* | 1/2010 | Kikuchi | C23C 22/44 428/450 |
| 2012/0083432 | A1 | 4/2012 | Hatasaki et al. | |

FOREIGN PATENT DOCUMENTS

| | | | |
|---|---|---|---|
| CN | 103173272 | A | 6/2013 |
| EP | 2450423 | A1 | 5/2012 |
| JP | 2000-063880 | A | 2/2000 |
| JP | 3227721 | B2 | 11/2001 |
| JP | 2002-317191 | A | 10/2002 |
| JP | 2008-081532 | A | 4/2008 |
| JP | 2008-111028 | A | 5/2008 |
| JP | 2011246684 | A | 12/2011 |
| JP | 2012-067146 | A | 4/2012 |
| JP | 2012-177000 | A | 9/2012 |
| WO | 02/12420 | A1 | 2/2002 |
| WO | 02/086038 | A1 | 10/2002 |
| WO | 2011/001653 | A1 | 1/2011 |

OTHER PUBLICATIONS

International Search Report issued in PCT/JP2014/067173 dated Sep. 9, 2014 (3 pages).
Official Action dated Aug. 9, 2016, issued by the Japan Patent Office in related Japanese Patent Application No. 2015-526257, with English translation (13 pages).
English Translation of the International Preliminary Report on Patentability and Written Opinion dated Jan. 12, 2016, by The International Bureau of WIPO in related International Application No. PCT/JP2014/067173 (11 pages).
EPO Communication with Extended European Search Report dated Nov. 29, 2016, issued by the European Patent Office in related European Patent Application No. EP-14823521.1 (7 pages).
Office Action dated Nov. 29, 2016, by the Korean International Patent Office (KIPO) in related Korean Patent Application No. KR 10-2016-7003416, with English machine translation (15 pages).

(Continued)

*Primary Examiner* — Bijan Ahvazi
*Assistant Examiner* — Thuy-Ai N Nguyen
(74) *Attorney, Agent, or Firm* — Osha Liang LLP

(57) ABSTRACT

A water-based lubricant for plastic working of a metallic material is obtained by adding to a water-based medium: (A) a polymer and/or a salt thereof containing a carboxylic acid or a derivative thereof as a constituent monomer; (B) an oxoacid of tungsten, of silicon, or of phosphorus, or a condensate thereof, and/or a salt thereof; (C) a hydroxide of an alkali metal; and (D) a lubricating component (D), and the solid content weight ratio (A)/[(A)+(B)+(C)+(D)] is 0.05 to 0.4.

17 Claims, No Drawings

(56) References Cited

OTHER PUBLICATIONS

Official Action dated Jan. 9, 2017, by the State Intellectual Property Office of The Peoples Republic of China (SIPO), in related Chinese Patent Application No. CN-201480038730.9, with English machine-translation (16 pages).
Examiner's Requisition (Office Action) dated Oct. 6, 2016, by the Canadian Intellectual Property Office in related Canadian Patent Application No. 2,917,710 (4 pages).
Examination Report issued in Canadian Application No. 2,917,710; dated Mar. 3, 2017 (2 pages).
Office Action issued in Chinese Application No. 201480038730.9; dated Mar. 17, 2017 (18 pages).

* cited by examiner

AQUEOUS LUBRICANT FOR PLASTIC WORKING OF METAL MATERIAL AND HAVING SUPERIOR GAS CLOGGING RESISTANCE AND POST-MOISTURE ABSORPTION WORKABILITY

CROSS REFERENCE TO RELATED APPLICATIONS

This is a national stage application of PCT/JP2014/067173, filed on Jun. 27, 2014, which claims priority to Japanese Patent Application No. JP 2013-144950, filed on Jul. 10, 2013. This application claims the benefits and priority of these prior applications and incorporates their disclosures by reference in their entireties.

TECHNICAL FIELD

The present invention relates to a water-based lubricant for use in plastic working of a metallic material, and more particularly, relates to a water-based lubricant for plastic working of a metallic material, which is excellent in workability after moisture absorption and scum clogging resistance.

BACKGROUND ART

There is a need to prevent seizures, galling, and heat generation due to metallic contact with molds in plastic working such as forging, extruding, and press working for metallic materials. For adapting to this need, films, oils, soaps and the like that have excellent lubricity have been used since a longtime ago. Above all, treatment with a zinc phosphate-based chemical conversion coating film and a soap-based lubricant (hereinafter, also referred to as bonder-lube treatment) has been often used, which is particularly excellent in workability and highly versatile.

However, high environmental loads have been a problem with the bonder-lube treatment. In the zinc phosphate-based chemical conversion treatment, the material to be treated is dissolved in the treatment liquid, thereby forming a by-product (sludge) with a phosphoric acid, and producing a large amount of industrial wastes. Moreover, in the bonder-lube treatment, effluents containing large amounts of heavy metals and effluent soaps are generated, thus requiring effluent treatment and treatment as industrial wastes. In recent years, new treatment methods of providing lubricity just by applying a water-based surface treatment agent to a metallic material and drying the agent have been developed in order to solve the problems as mentioned previously.

As such a technique, Patent Literature 1 discloses a technique of containing a water-soluble inorganic salt and a wax, etc. dissolved or dispersed in water.

Patent Literature 2 discloses a technique that relates to a lubricating composition for plastic working, containing a synthetic resin, a water-soluble inorganic salt, and water.

Patent Literature 3 discloses a technique that relates to a lubricant for plastic working, obtained by dispersing or dissolving, in water, 10 to 30% of a water-soluble inorganic salt, 5 to 30% of an organometallic salt, 10 to 84.5% of an alkaline-earth metal salt, and as a solid dispersant, 0.5 to 30% of a product of a reaction between a copolymer of α-olefin and maleic anhydride and N,N-dialkylaminoalkylamine.

Patent Literature 4 discloses a technique for a water-based lubricant composition for plastic working, containing a water-soluble polymer compound, an inorganic metal salt, and water.

CITATION LIST

Patent Literature

Patent Literature 1: International Publication No. WO 2002/012420
Patent Literature 2: JP 2000-63880 A
Patent Literature 3: JP 2008-111028 A
Patent Literature 4: JP 2012-177000 A

SUMMARY OF INVENTION

Technical Problem

As described previously, the variety of water-based lubricants for plastic working has been developed, and as the water-soluble inorganic salt or inorganic metal salt in Patent Literatures 1 to 4, borates are used as preferred substances. Lubrication films formed from the borates have the advantages such as film strength required as a lubricant and also excellent adhesion to metallic material surfaces. However, boron and compounds thereof are classified as the Class I Designated Chemical Substances in the Law concerning Pollutant Release and Transfer Register (PRTR). Among the borates, sodium tetraborate and boric acid are suspected to be hazardous as the SVHC in the REACH, the use of the borate degrades the effluent treatment performance, and the development of water-based lubricants for plastic working without use of any borate has been thus desired. In addition, in general, lubrication films from water-based lubricants have the drawback of absorbing moisture in the atmosphere. The lubrication films have the property of lubricity significantly decreased by moisture absorption, and it is extremely difficult to store, for long periods of time, metallic materials with boron-containing lubricants applied. As described above, any water-based lubricant for plastic working of a metallic material has not been developed which keeps high lubricity without seizures caused, even when the lubricant is left under a high-humidity environment.

On the other hand, in plastic working, the wax in a lubricant scum separated from the metallic material is not be able to be easily removed when the wax adheres to the mold, thereby causing underfill, or leading to a broken knock-out pin. The wax is, because of having high lubricity, one of components that are not able to be removed in non-reactive lubricants. Therefore, frequent cleaning currently deals with the scum caused by the wax, and the development of water-based lubricants for plastic working of a metallic material, which can suppress scum clogging, has been desired strongly.

It is to be noted that Patent Literature 1 mentions that: "the mold is unfavorably clogged with scums or the like when the coating weight is large", whereas Patent Literature 4 mentions "it is preferable to contain a solid lubricant in the case of taking measures against moisture absorption of the lubrication film", but sufficient measures have not been taken against the problem of scum generation and for working after moisture absorption.

The present invention is intended to solve the previously mentioned problems of the prior art, and an object of the invention is to provide a water-based lubricant for plastic working of a metallic material, which is comparable or superior in workability to the bonder-lube treatment and conventional coating-type water-based lubricants, and excellent in workability after moisture absorption and scum clogging resistance.

Solution to Problem

The inventors have found, as a result of carrying out earnest studies in order to achieve the previously mentioned object, that high workability, and excellent seizure resistance, workability after moisture absorption, and scum clogging resistance are provided when as a water-based lubricant for plastic working of a metallic material, a specific polymer, a specific oxoacid or condensate thereof or the like, a hydroxide of an alkali metal, and a lubricating component are added in certain proportions to a water-based medium, thereby achieving the present invention.

That is, provided is a water-based lubricant for plastic working of a metallic material according to the present invention, wherein the water-based lubricant is obtained by adding to a water-based medium: (A) a polymer and/or a salt thereof containing a carboxylic acid or a derivative thereof as a constituent monomer; (B) an oxoacid of tungsten, of silicon, or of phosphorus, or a condensate thereof, and/or a salt thereof; (C) a hydroxide of an alkali metal; and (D) a lubricating component (D), and a solid content weight ratio (A)/[(A)+(B)+(C)+(D)] is 0.05 to 0.40.

In addition, the pH is preferably 7 to 12.

In addition, the component (C) is preferably a lithium hydroxide.

In addition, a molar ratio (B)/(C) of the component (B) and the component (C) is preferably 0.3 to 2.7.

In addition, a solid content weight ratio (D)/[(A)+(B)+(C)+(D)] is preferably 0.1 to 0.3.

In addition, the component (D) essentially preferably includes two components of: (a) a wax and (b) an acidic phosphoric ester-based extreme-pressure agent, and a solid content weight ratio (a)/(b) of the component (a) and the component (b) is preferably 0.2 to 9.0.

In addition, the component (a) preferably has an average particle size of 30 to 1000 nm.

In addition, the component (a) is preferably a polyethylene wax with a melting point of 130 to 170° C.

In addition, the component (b) is preferably a phosphoric ester having an ether linkage or a C1 to C20 alkyl group, the phosphoric ester being able to be dispersed and/or dissolved in an alkaline aqueous solution.

The present invention relates to a method for producing a metallic material with a lubrication film, including a step of bringing the water-based lubricant for plastic working of a metallic material according to the present invention into contact with a metallic material, and thereafter evaporating moisture, thereby forming a lubrication film on a surface of the metallic material.

The present invention relates to a metallic material including, on a surface thereof, a lubrication film obtained from the water-based lubricant for plastic working of a metallic material according to the present invention.

Advantageous Effects of Invention

The water-based lubricant for plastic working of a metallic material according to the present invention is high in workability, and excellent in seizure resistance, workability after moisture absorption, and scum clogging resistance. It is to be noted that the terms "after moisture absorption" refer to "after leaving under a high-humidity condition". In addition, the water-based lubricant for plastic working of a metallic material according to the present invention has few hazardous substances, requires no reactive treatment with zinc phosphate or the like, and thus can achieve resource saving while reducing environmental loads. In addition, because of being a moisture-absorption-resistant lubricant for plastic working, it is possible to store the material after lubricating treatment. Furthermore, for reasons such as having the advantage of being able to improve the workability by significantly reducing the scum clogging without causing a decrease in lubricity, which decreases the lifetime of a mold, it has an extremely high industrial worth.

DESCRIPTION OF EMBODIMENTS

The composition of the water-based lubricant for plastic working of a metallic material according to the present invention will be described in detail below.

<Composition>

[Component (A)]

The polymer and/or a salt thereof (A) containing a carboxylic acid or a derivative thereof as a constituent monomer (hereinafter, referred to as a "component (A)") according to the present invention is a component that has an effect as a dispersant for a lubricating component (D), and has a film formation property. In this regard, the "carboxylic acid derivative" refers to a carboxyl group with a hydroxyl group therein substituted with other atom or an atom group, and specific examples thereof include acyl halides, acid anhydrides, esters, amides, and nitriles. The component (A) is not to be considered particularly limited, but preferably has a weight average molecular weight of 50,000 to 170,000, more preferably 50,000 to 150,000, and particularly preferably 55,000 to 75,000. The weight average molecular weight of 50,000 to 170,000 improves, due to the increased dispersion effect, the dispersibility of the lubricating component (D), thereby achieving a homogeneous lubricant for plastic working. The weight average molecular weight in the present invention refers to a value measured by GPC (gel permeation chromatogram), which can be measured with the use of, for example, a GPC measurement device from Shimadzu Corporation.

Specific examples of the component A include, not particularly limited thereto, copolymerized polymers of isobutylene and maleic anhydride, imidized products of copolymerized polymers of isobutylene and maleic anhydride, urethane resins, acrylic resins, alkyd resins, polyester resins, amino resins, modified epoxy resins, epoxy resins, ether resins, and polyvinyl alcohols. Among these examples, for the reason of excellent liquid stability, the constituent monomer containing therein a carboxyl group and an imide group is preferred, and specific examples thereof include imidized products of copolymerized polymers of isobutylene and maleic anhydride. One of these components (A) may be used alone, or two or more thereof may be used in combination.

[Component (B)]

The oxoacid of tungsten, of silicon, or of phosphorus, or a condensate thereof, and/or a salt thereof (B) (hereinafter, referred to as a "component (B)") according to the present invention is a component which serves to improve seizure resistance and adhesion (the improved adhesion suppresses the generation of the wax or the like separated from the metallic material, thus improving the scum clogging resistance).

Specific examples of the component (B) include, not limited thereto, sodium tungstate, ammonium tungstate, potassium tungstate, sodium silicate, potassium silicate, sodium tripolyphosphate, potassium tripolyphosphate, and ammonium tripolyphosphate. In particular, tungstates and phosphates are preferred. Furthermore, one of these examples may be used alone, or two or more thereof may be used in combination.

[Component (C)]

The hydroxide of an alkali metal (C) (hereinafter, referred to as a "component (C)") refers to a component which is effective for improved moisture absorption resistance and workability, and for seizure resistance. Examples of the component (C) include lithium hydroxide, sodium hydroxide, and potassium oxide. It is to be noted that the component (C) may be a hydrate. Among these examples, the lithium hydroxide or hydrate is preferred.

[Component (D)]

Examples of the lubricating component (D) (hereinafter, referred to as a "component (D)") can include lubricants such as oils, waxes and soaps; acidic phosphoric esters or sulfur-based extreme-pressure additives; and solid lubricants. Above all, the soaps and waxes, and the acidic phosphoric esters are preferred, and it is further preferably composed of a wax (a) and an acidic phosphoric ester (b).

The wax (a) itself has lubricity, and the present thereof at the interface serves to reduce frictions between metals, and suppress seizures and the like. The wax (a) is not to be considered particularly limited, but examples thereof include a paraffin wax, a microcrystalline wax, a polypropylene wax, and a carnauba wax, and the polyethylene wax is most preferred. As for the use of the wax, a wax may be used alone, or two or more waxes may be used in combination. The wax (a) preferably has an average particle size of 30 to 1000 nm, more preferably 100 to 500 nm. In this regard, the average particle size in the present invention refers to a value measured with the use of a microtrack method (laser diffraction-scattering method), which can be measured with, for example, a particle size distribution measuring instrument (Model LA-920, particle size criteria: volume) from Horiba, Ltd.

The wax (a) is preferably a polyethylene wax with a melting point of 130 to 170° C., and the melting point of the wax (a) is more preferably 140 to 170° C. The average particle size of 30 to 1000 nm (more preferably 100 to 500 nm) suppresses agglomeration, thereby enhancing dispersibility in water. In addition, it has been found that the melting point of 130 to 170° C. (in particular, 140 to 170° C.) advantageously acts on scum clogging resistance. There are some cases where the heat generation during plastic working may melt the wax component and cause the melted component to adhere to the mold, thereby causing underfill or causing the mold to be broken, but the use of the wax with a melting point of 130 to 170° C. can suppress melting of the wax and the adhesion to the mold. Thus, the lifetime of the mold can be extended, and the generation of underfill can be suppressed.

The acidic phosphoric ester-based extreme-pressure agent (b) has the effect of reducing the friction and abrasion at the metal interface and preventing seizures. The acidic phosphoric ester-based extreme-pressure agent (b) is not to be considered particularly limited, but specifically, one may be used alone from alkyl acid phosphates, dioleyl hydrogen phosphite, polyether phosphates, and the like, or two or more therefrom may be used in combination. In addition, the acidic phosphoric ester-based extreme-pressure agent (b) according to the present invention is a phosphoric ester having an ether linkage and/or a C1 to C20 alkyl group, which is preferably able to be dispersed and/or dissolved in an alkaline aqueous solution. This acidic phosphoric ester-based extreme-pressure agent achieves favorable workability, seizure resistance, and scum clogging resistance.

In addition, for example, soaps such as fatty acid soaps and fatty acid metal soaps, fatty acid amides, and the like can be used as lubricants other than the wax (a). Specific examples of the fatty acid soaps and fatty acid metal soaps include metal soaps such as calcium stearate, zinc stearate, barium stearate, magnesium stearate, and zinc stearate. In addition, specific examples of the fatty acid amides include ethylene bislauric acid amide, ethylene bisstearic acid amide, ethylene bisbehenic acid amide, N—N'-distearyl adipic acid amide, ethylene bisoleic acid amide, ethylene biserucic acid amide, hexamethylene bisoleic acid amide, N—N'-dioleyl adipic acid amide, stearic acid, oleic acid, palm oil, and mineral oil.

[Other Components]

The water-based lubricant for plastic working of a metallic material for use in the present invention is able to use levelling agents or water-soluble solvents for improving coating properties, metal stabilizers, etching inhibitors, etc. to the extent that advantageous effects of the invention will not be damaged. The levelling agents include nonionic or cationic surfactants. The water-soluble solvents include: alcohols such as ethanol, isopropyl alcohol, t-butyl alcohol, and propylene glycol; cellosolves such as ethylene glycol monobutyl ether and ethylene glycol monoethyl ether; esters such as ethyl acetate and butyl acetate; and ketones such as acetone, methyl ethyl ketone, and methyl isobutyl ketone. The metal stabilizers include chelate compounds such as EDTA and DTPA. The etching inhibitors include amine compounds such as ethylenediamine, triethylenepentane, guanidine, and pyrimidine. In particular, compounds having two or more amino groups in one molecule are also effective as metal stabilizers, which are more preferred.

The solvent of the water-based lubricant according to the present invention is mainly composed of water. In this regard, the phrase "mainly composed of water" means that water accounts for approximately 50 volume % or more on the basis of the total volume of the solvent.

<Blending Amount>

In regard to the blending proportion of the component (A) of the water-based lubricant for plastic working of a metallic material according to the present invention, the solid content weight ratio (A)/[(A)+(B)+(C)+(D)] is required to be 0.05 to 0.40, preferably 0.05 to 0.25, and most preferably 0.08 to 0.20. The solid content weight ratio (A)/[(A)+(B)+(C)+(D)] of less than 0.05 unfavorably degrades the film formation property, thereby resulting in a brittle film, whereas the ratio in excess of 0.40 unfavorably makes the other components less likely to be dissolved, thereby degrading the liquid stability.

The molar ratio (B)/(C) of the component (B) to the component (C) is preferably 0.30 to 2.7, more preferably 0.6 to 2.2. The molar ratio (B)/(C) in this range inhibits crystallization of inorganic salts in films, thereby resulting in effectiveness for workability after moisture absorption.

The solid content weight ratio (D)/[(A)+(B)+(C)+(D)] is preferably 0.1 to 0.3. Above all, the ratio of 0.12 to 0.28 is most preferred because a balance is achieved between scum clogging resistance and lubricity. The ratio less than 0.1 results in deficient lubricity, thereby significantly decreasing workability. The ratio in excess of 0.3 increases the generation of scum during working.

In addition, in the case of using the wax (a) and the acidic phosphoric ester-based extreme-pressure agent (b) as the component (D), for the blending amounts of the wax (a) and acidic phosphoric ester-based extreme-pressure agent (b), the solid content weight ratio (a)/(b) is preferably 0.2 to 9.0, and more preferably 1.0 to 6.0. The ratio less than 0.2 results in failure to efficiently achieve the effect of the wax, thereby making lubricity more likely to be deficient. The ratio in excess of 9.0 results in failure to efficiently achieve the effect of the acidic phosphoric ester-based extreme-pressure agent, thereby making workability more likely to be deficient.

<Properties>

The pH of the water-based lubricant according to the present invention is preferably 7 to 12, more preferably 8 to 11. In this regard, the pH refers to a value measured at 20 to 30° C. (room temperature) with the use of a pH meter (portable pH meter HM-31P from DKK-TOA CORPORATION). In addition, when the pH of the water-based lubricant is less than 7, the agglomeration or the like of the wax (a) may be caused. On the other hand, when the pH exceeds 12, the dispersibility of the wax (a) may be destroyed, thereby causing the agglomeration. It is to be noted that while ammonia, amines, and the like can be also used as the alkali component used for the pH adjustment, the component is not to be considered particularly limited.

<Application Method>

The step of applying the water-based lubricant according to the present invention to the metallic material is not to be considered particularly limited, but can use a dipping method, a flow coating method, a spray method, etc. The application (coating) may employ any method as long as the surface is sufficiently covered with the water-based lubricant according to the present invention, and there is not a particular limit on the time for the application. In this regard, in order to enhance drying properties in this case, the metallic material heated (for example, 40 to 80° C.) may be brought into contact with the water-based lubricant for plastic working of a metallic material. In addition, the heated (for example, 30 to 50° C.) water-based lubricant for plastic working of a metallic material may be brought into contact. Thus, the drying properties may be improved significantly to allow drying at ordinary temperature, and the loss of thermal energy can be also reduced.

In this regard, the coating weight of the lubrication film formed on the metallic surface is controlled appropriately depending on the degree of subsequent working and economy. The coating weight preferably falls within range of 0.5 to 40 g/m$^2$, more preferably 2 to 20 g/m$^2$. When this coating weight is less than 0.5 g/m$^2$, the lubricity will be insufficient. Alternatively, the coating weight in excess of 40 g/m$^2$ unfavorably causes the mold to be clogged with scums or the like, although there is no problem with lubricity. It is to be noted that coating weight can be calculated from the weight difference of the metallic material between before and after working, and the surface area thereof. The solid content weight (concentration) of the water-based lubricant is adjusted appropriately in order to control the coating weight in the previously described range. In fact, in many cases, a high concentration of lubricant is diluted with water, and the treatment liquid is used.

The metallic material for use in the present invention is preferably iron, steel, stainless steel, aluminum, an aluminum alloy, magnesium, a magnesium alloy, titanium, a titanium alloy, copper, a copper alloy, tin, a tin alloy, or the like. In addition, in terms of shape, the metallic material to which the present invention is directed is not to be considered particularly limited, but intended to encompass, for example, not only materials such as wring rods, tube materials, bar materials, and block materials, but also shaped articles (gears, shafts, etc.).

The surface of the metallic material for use in the present invention is preferably cleaned by at least one or more methods selected from alkali cleaning, acid cleaning, sand blasting, and shotblasting. The use of the surface left contaminated causes the lubrication film to drop, and adversely affects subsequent lubricity.

EXAMPLES

Next, the present invention will be further described with reference to examples. However, the present invention is not to be considered limited to the following example.

(1) Preparation of Water-Based Lubricant for Plastic Working

The component (A), the component (B), the component (C), and the component (D) were added to water in the combinations and proportions shown in Table 6 (the total amount of the component (B) and component (C) was adjusted so that the total amount of the components (A) to (D) accounts for 1 with the proportions of the component (A) and component (D) as shown in Table 6) to prepare water-based lubricants for plastic working according to Examples 01 to 34 and Comparative Examples 01 to 19. In all of the water-based lubricants, the ratio by weight between total solid content and water was adjusted to 18.8:85. It is to be noted that the water-based lubricants were diluted with water to adjust the concentrations so that dried lubrication films account for the intended film weight, and then used. In addition, the respective components were used as listed in Tables 1 to 5.

(2) Lubricating Treatment for Cold Forging Test

The water-based lubricants according to Examples 01 to 34 and Comparative Examples 01 to 19 were applied to evaluation test pieces to form lubrication films. Here are pretreatment and lubricating treatment steps. Evaluation test pieces: S45C spheroidal annealed material 25 mmΦ×30 mm

Pretreatment and Lubricating Treatment According to Examples 01 to 34 and Comparative Examples 01 to 19

(a) Degreasing (Pretreatment): commercially available degreasing agent (Product Name: FINECLEANER 4360, from NIHON PARKERIZING CO., LTD.), Concentration: 20 g/L, Temperature: 60° C., Immersion: 10 min.

(b) Water Rinsing (Pretreatment): Tap Water, Ordinary Temperature, Immersion: 30 sec.

(c) Lubricating Treatment (Lubricating Treatment): Water-based Lubricant prepared in (1), Temperature: 60° C., Immersion: 1 min.

(d) Drying (Lubricating Treatment): 100° C., 10 min.

Here are pretreatment and lubricating treatment steps of bonder-lube treatment according to Comparative Example 22.

Pretreatment and Lubricating Treatment of Bonder-Lube Treatment According to Comparative Example 22

(a) Degreasing (Pretreatment): commercially available degreasing agent (Product Name: FINECLEANER 4360, from NIHON PARKERIZING CO., LTD.), Concentration: 20 g/L, Temperature: 60° C., Immersion: 10 min.

(b) Water Rinsing (Pretreatment): Tap Water, Ordinary Temperature, Immersion: 30 sec.

(c) Acid Cleaning (Pretreatment): Hydrochloric Acid, Concentration: 17.5%, Ordinary Temperature, Immersion: 10 min.

(d) Water Rinsing (Pretreatment): Tap Water, Ordinary Temperature, Immersion: 30 sec.

(e) Chemical Conversion Treatment (Lubricating Treatment): commercially available zinc phosphate chemical conversion treatment agent (Product Name: PALBOND 181X, from NIHON PARKERIZING CO., LTD.), Concentration: 90 g/L, Temperature: 80° C., Immersion: 10 min.

(f) Water Rinsing (Lubricating Treatment): Tap Water, Ordinary Temperature, Immersion: 30 sec.

(g) Soap Treatment (Lubricating Treatment): commercially available soap lubricant (Product Name: PALUBE 235, from NIHON PARKERIZING CO., LTD.), Concentration: 70 g/m$^2$, 85° C., Immersion: 3 min.

(h) Drying (Lubricating Treatment): 100° C., 10 min (i) Dried Film weight: approximately 10 g/m$^2$ Here are pretreatment and lubricating treatment steps according to Comparative Example 23.

Pretreatment and Lubricating Treatment According to Comparative Example 23

(a) Degreasing (Pretreatment): commercially available degreasing agent (Product Name: FINECLEANER 4360, from NIHON PARKERIZING CO., LTD.), Concentration: 20 g/L, Temperature: 60° C., Immersion: 10 min.

(b) Water Rinsing (Pretreatment): Tap Water, Ordinary Temperature, Immersion: 30 sec.

(c) Lubricating Treatment (Lubricating Treatment): Water-based Lubricant (Water-based Lubricant described in Example 02 of International Publication No. WO 2002/012420), Temperature: 60° C., Immersion: 1 min.

(d) Drying (Lubricating Treatment): 100° C., 10 min.

Here are pretreatment and lubricating treatment steps according to Comparative Examples 20 to 21.

Pretreatment and Lubricating Treatment According to Comparative Examples 20 to 21

(a) Degreasing (Pretreatment): commercially available degreasing agent (Product Name: FINECLEANER 4360, from NIHON PARKERIZING CO., LTD.), Concentration: 20 g/L, Temperature: 60° C., Immersion: 10 min.

(b) Water Rinsing (Pretreatment): Tap Water, Ordinary Temperature, Immersion: 30 sec.

(c) Lubricating Treatment (Lubricating Treatment): Water-based Lubricant (Plastic Working Agent described in Example 04 of JP 2012-177000 A), Temperature: 60° C., Immersion: 1 min.

(d) Drying (Lubricating Treatment): 100° C., 10 min.

(3) Cold Forging Test

The test pieces subjected to the lubricating treatment by the method (2) were evaluated by a cold forging test for lubricity of the lubrication films after statically leaving for 24 hours under an atmosphere at a temperature of 30° C. and humidity of 70%, lubricity thereof immediately after the lubricating treatment, and seizure resistance. In the cold forging test, the spike formation (spike test) in accordance with the invention in Japanese Patent No. 3227721 was carried out to measure the indentation load (kNf) and spike height (mm), thereby evaluating lubricity. In addition, the worked surfaces of the test pieces were visually observed for the degree of seizure to evaluate the seizure resistance.

<Criteria in Spike Test>

Lubricity (Workability immediately after Treatment and Workability immediately after Statically Leaving in Moisture Absorption Environment)

Performance Value=Spike Height (mm)/Indentation Load (kNf)×100

The larger value means more favorable lubricity.

◎: 0.95 or more

○: 0.93 or more and less than 0.95

Δ: 0.9 or more and less than 0.93

X: less than 0.9

<Seizure Resistance>

The degree of seizure at the worked surface

◎: no seizure

○: mild seizure

Δ: moderate seizure

X: heavy seizure

<Generation of Scum>

Evaluated from the amount of scum dropping in the case of upsetting

◎: scum dropping percentage of 0% or more and less than 30%

○: scum dropping percentage of 30% or more and less than 50%

Δ: scum dropping percentage of 50% or more and less than 70%

X: scum dropping percentage of 70% or more (4) Evaluation of Liquid Stability

The water-based lubricating agents for plastic working, adjusted under the condition (1) were visually evaluated for appearance after 3 days.

Evaluation of Liquid Stability

◎: no change

○: slight agglomeration found

Δ: agglomeration found

X: precipitation found

Table 7 shows evaluation results. From Table 7, the water-based lubricants for plastic working of a metallic material according to the present invention was excellent in workability, seizure resistance, workability after moisture absorption, scum clogging resistance, and liquid stability. In contrast, the conventional water-based lubricants for plastic working of a metallic material, that is, Comparative Examples 20 to 21 and Comparative Example 23 were inferior in workability, seizure resistance, workability after moisture absorption, or scum clogging resistance in some cases. In addition, Comparative Examples 01 and 02 and Comparative Examples 09 to 14 containing no component (A) are poor in film formation property, and in the case of being subjected to working, lubrication films are more likely to be peeled, thereby causing seizure or defective working. On the other hand, Comparative Example 03 and Comparative Examples 15 to 18 not including the addition range of the component (A) make, because of the low solubility of the component (A), the component (B) and the component (C) less likely to be dissolved, thereby degrading liquid stability. Moreover, Comparative Example 04 containing no component (B) is poor in adhesion to the metal, and the lubrication film formed is not able to withstand working. Comparative Example 07 containing no component (C) is not able to be subjected to working after moisture absorption, due to the fact that the film component is crystallized, thereby making the adhesion, etc. likely to be degraded, when moisture is absorbed. In addition, Comparative Example 08 containing no lubricating component (D) is not able to be subjected to working, due to deficient lubricity. Comparative Examples 05 and 06 containing a salt (borate or iodate) other than the oxoacid of tungsten, of silicon, or of phosphorus, or a condensate thereof, and/or a salt thereof have problems such as a large generation of scum. It is to be noted that as can be seen from Comparative Example 22, Examples 01 to 34 have, in spite of the low environmental load, performance comparable to the comparative example subjected to the bonder-lube treatment.

Next, the composition ratios of the constituents in the examples will be summarized. From a comparison between Example 01 and Examples 08 to 10, it is determined that the workability is improved when the solid content weight ratio (A)/[(A)+(B)+(C)+(ID)] is increased, while it is determined that the liquid stability is degraded when the ratio is excessively increased. As a cause of the improved workability, the increased strength of the film is considered because of the increased film formation property. As a cause of the degraded liquid stability, the component (B) and component (C) made less likely to be dissolved are considered because of the low solubility of the component (A). It is determined that films, which are really excellent in workability also with favorable liquid stability, can be formed in the most preferred range (0.08 to 0.2).

Subsequently, from a comparison between Example 01 and Examples 14 and 15, it is determined that the increased molar ratio (B)/(C) is advantageous for working after moisture absorption. This is because of inhibiting crystallization of the inorganic salt in the film. However, the excessively increased molar ratio has a tendency to degrade the liquid stability, and also decrease the workability after moisture absorption under the influence of solubility. It is determined that films, which are really excellent in workability after moisture absorption also with favorable dispersibility, can be formed in the most preferred range (0.6 to 2.2).

In regard to the solid content weight ratio (a)/(b) of the wax (a) and the acidic phosphoric ester-based extreme-pressure agent (b), from a comparison between Example 01 and Examples and 24, the value increased results in failure to sufficiently achieve the effect of the extreme-pressure agent, thereby causing seizures to be generated or the workability to be decreased. Reversely, the value decreased adversely affects the generation of scum or the liquid stability. This is because the component of the extreme-pressure agent is less likely to be dispersed well in water. From a comparison between Example 01 and Examples 02, 03, and 25, it is determined that the increased solid content weight ratio (D)/[(A)+(B)+(C)+(D)] has a tendency to improve the workability, while it is determined that the excessively increased ratio has a tendency to cause scum clogging. In the preferred range (0.12 to 0.28), the lubricating component has the effect of providing the liquid stability and suppressing the generation of scum.

Subsequently, the influence of the constituents in the examples will be summarized. In regard to the component (B), from a comparison among Examples 01, 11, and 12, it is determined that the performance is all superior in the case of using the tungstate and the phosphate to in the case of using the silicate. In regard to the component (C), from a comparison between Example 01 and Examples 13, 29, and 30, it is determined that the workability, seizure resistance, and liquid stability are superior in the case of using the lithium hydroxide or hydrate thereof to in the case of using the hydroxide of other alkali metal. In regard to the wax component (a) of the component (D), from a comparison among Examples 01, 17, 18, 19, 27, and 28, it is determined that Examples 01 and 17 using the waxes with melting points included in the preferred range have smaller generations of scums. It is determined that Examples 01, 17, and 28 with average particle sizes included in the preferred range have excellent liquid stability. Outside this range, there is a tendency to be inferior in liquid stability. In regard to the acidic phosphoric ester (b), from a comparison among Examples 01, 20, 21, and 22, it is determined that Example 01 using, as the acidic phosphoric ester (b), the compound having the preferred ether linkage has the suppressed generation of scum. Furthermore, in regard to the component (D), from a comparison between Examples 01 and 34, it is determined that Example 01 using the wax with a melting point and an average particle size included in the preferred ranges has a smaller generation of scum, and also better liquid stability than Example 34 using a zinc stearate (a6) as a fatty acid soap in place of the wax component (a).

TABLE 1

| Symbol | Chemical Name | Molecular weight |
|---|---|---|
| A1 | Isobutylene-based Polymer, Imidized | 55000~65000 |
| A2 | Ether-based Polymer | 150000 |
| A3 | Isobutylene-based Polymer, Ammonia-modified | 55000~65000 |
| A4 | Isobutylene-based Polymer | 160000~170000 |
| A5 | Isobutylene-based Polymer | 5500~6500 |
| A6 | Polyethylene Imine | 70000 |
| A7 | Urethane Resin | 5000 |

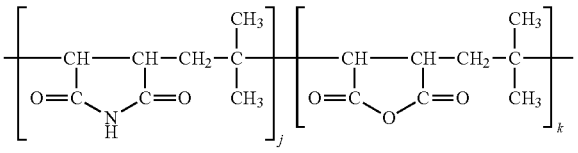

Structure of Symbol A1 (j and k vary within the range of the molecular weight)

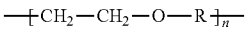

Structure of Symbol A2 (n varies within the range of the molecular weight, R represents an aromatic hydrocarbon including a carboxyl group)

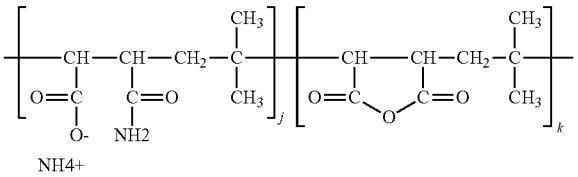

Structure of Symbol A3 (j and k vary within the range of the molecular weight)

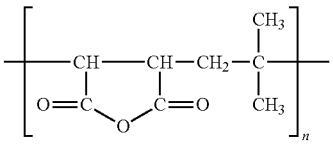

Structure of Symbols A4, A5

$H_2N(C_2H_5N)_nH$ Chemical Formula of Symbol A6

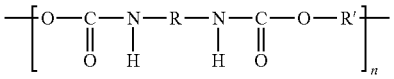

Chemical Formula of Symbol A7 (R represents an ester-based substituent, R' represents an ether-based substituent)

TABLE 2

| Symbol | Name |
|---|---|
| B1 | Sodium Tripolyphosphate |
| B2 | Sodium Tungstate |
| B3 | Potassium Silicate |
| B4 | Potassium Tetraborate |
| B5 | Sodium Iodate |

TABLE 3

| Symbol | Name |
|---|---|
| C1 | Lithium Hydroxide |
| C2 | Potassium Hydroxide |

TABLE 3-continued

| Symbol | Name |
|---|---|
| C3 | Sodium Hydroxide |
| C4 | Lithium Hydroxide Monohydrate |

TABLE 4

| Symbol | | Particle Size (μm) | Melting Point (° C.) |
|---|---|---|---|
| a1 | Low-Density Polyethylene Wax A | 0.5 | 132 |
| a2 | Low-Density Polyethylene Wax B | 0.1 | 150 |
| a3 | Low-Density Polyethylene Wax C | 9.5 | 110 |
| a4 | Low-Density Polyethylene Wax D | 6.0 | 113 |
| a5 | Low-Density Polyethylene Wax E | 0.6 | 113 |
| a6 | Zinc Stearate | — | — |

TABLE 5

| Symbol | Chemical Name | Melting Point (° C.) | Carbon Number |
|---|---|---|---|
| b1 | Alkyl Phosphoric Ester | 197 | 12~18 |
| b2 | Butyl Phosphoric Ester | 180 | 4 |
| b3 | Polyoxypropylene Phosphoric Ester | 100 or more | 2~10 |
| b4 | Tetracosyl Phosphoric Ester | 222 | 24 |

TABLE 6

| | Polymer of Carboxylic Acid (A) | | | | | Lubricant (D) | | | | | |
|---|---|---|---|---|---|---|---|---|---|---|---|
| | Component (A) | (A)/(A) + (B) + (C) + (D) | Component (B) | Component (C) | Molar Ratio (B)/(C) | Component a | Component b | a/b | (D)/(A) + (B) + (C) + (D) | ($g/m^2$) | pH |
| Example Treatment Agent 01 | A1 | 0.15 | B1 | C1 | 1.2 | a2 | b3 | 4.0 | 0.25 | 5 | 9 |
| Example Treatment Agent 02 | A1 | 0.15 | B1 | C1 | 1.2 | a2 | b3 | 4.0 | 0.09 | 5 | 9 |
| Example Treatment Agent 03 | A1 | 0.15 | B1 | C1 | 1.2 | a2 | b3 | 4.0 | 0.35 | 5 | 9 |
| Example Treatment Agent 04 | A2 | 0.15 | B1 | C1 | 1.2 | a2 | b3 | 4.0 | 0.25 | 5 | 9 |
| Example Treatment Agent 05 | A3 | 0.15 | B1 | C1 | 1.2 | a2 | b3 | 4.0 | 0.25 | 5 | 9 |
| Example Treatment Agent 06 | A1 | 0.15 | B1 | C1 | 1.2 | a2 | b3 | 4.0 | 0.25 | 3 | 9 |
| Example Treatment Agent 07 | A4 | 0.15 | B1 | C1 | 1.2 | a2 | b3 | 4.0 | 0.25 | 5 | 9 |
| Example Treatment Agent 08 | A1 | 0.05 | B1 | C1 | 1.2 | a2 | b3 | 4.0 | 0.25 | 5 | 9 |
| Example Treatment Agent 09 | A1 | 0.25 | B1 | C1 | 1.2 | a2 | b3 | 4.0 | 0.25 | 5 | 9 |
| Example Treatment Agent 10 | A1 | 0.4 | B1 | C1 | 1.2 | a2 | b3 | 4.0 | 0.25 | 5 | 9 |
| Example Treatment Agent 11 | A1 | 0.15 | B2 | C1 | 1.2 | a2 | b3 | 4.0 | 0.25 | 5 | 9 |
| Example Treatment Agent 12 | A1 | 0.15 | B3 | C1 | 1.2 | a2 | b3 | 4.0 | 0.25 | 5 | 9 |
| Example Treatment Agent 13 | A1 | 0.15 | B1 | C2 | 1.2 | a2 | b3 | 4.0 | 0.25 | 5 | 9 |
| Example Treatment Agent 14 | A1 | 0.15 | B1 | C1 | 0.05 | a2 | b3 | 4.0 | 0.25 | 5 | 9 |
| Example Treatment Agent 15 | A1 | 0.15 | B1 | C1 | 2.5 | a2 | b3 | 4.0 | 0.25 | 5 | 9 |
| Example Treatment Agent 16 | A1 | 0.15 | B1 | C1 | 1.2 | a2 | b3 | 4.0 | 0.25 | 10 | 9 |
| Example Treatment Agent 17 | A1 | 0.15 | B1 | C1 | 1.2 | a1 | b3 | 4.0 | 0.25 | 5 | 9 |
| Example Treatment Agent 18 | A1 | 0.15 | B1 | C1 | 1.2 | a2 | b3 | 4.0 | 0.25 | 20 | 9 |
| Example Treatment Agent 19 | A1 | 0.15 | B1 | C1 | 1.2 | a3 | b3 | 4.0 | 0.25 | 5 | 9 |
| Example Treatment Agent 20 | A1 | 0.15 | B1 | C1 | 1.2 | a2 | b1 | 4.0 | 0.25 | 5 | 9 |
| Example Treatment Agent 21 | A1 | 0.15 | B1 | C1 | 1.2 | a2 | b2 | 4.0 | 0.25 | 5 | 9 |
| Example Treatment Agent 22 | A1 | 0.15 | B1 | C1 | 1.2 | a2 | b4 | 4.0 | 0.25 | 5 | 9 |
| Example Treatment Agent 23 | A1 | 0.15 | B1 | C1 | 1.2 | a2 | b3 | 0.9 | 0.25 | 5 | 9 |
| Example Treatment Agent 24 | A1 | 0.15 | B1 | C1 | 1.2 | a2 | b3 | 6.1 | 0.25 | 5 | 9 |
| Example Treatment Agent 25 | A1 | 0.15 | B1 | C1 | 1.2 | a2 | b3 | 4.0 | 0.1 | 5 | 9 |
| Example Treatment Agent 26 | A5 | 0.15 | B1 | C1 | 1.2 | a2 | b3 | 4.0 | 0.25 | 5 | 9 |
| Example Treatment Agent 27 | A1 | 0.15 | B1 | C1 | 1.2 | a4 | b3 | 4.0 | 0.25 | 5 | 9 |
| Example Treatment Agent 28 | A1 | 0.15 | B1 | C1 | 1.2 | a5 | b3 | 4.0 | 0.25 | 5 | 9 |
| Example Treatment Agent 29 | A1 | 0.15 | B1 | C3 | 1.2 | a2 | b3 | 4.0 | 0.25 | 5 | 9 |
| Example Treatment Agent 30 | A1 | 0.15 | B1 | C4 | 1.2 | a2 | b3 | 4.0 | 0.25 | 5 | 9 |
| Example Treatment Agent 31 | A7 | 0.15 | B1 | C1 | 1.2 | a2 | b3 | 4.0 | 0.25 | 5 | 9 |
| Example Treatment Agent 32 | A1 | 0.15 | B1 | C1 | 1.2 | a2 | b3 | 4.0 | 0.25 | 5 | 6 |
| Example Treatment Agent 33 | A1 | 0.15 | B1 | C1 | 1.2 | a2 | b3 | 4.0 | 0.25 | 5 | 14 |
| Example Treatment Agent 34 | A1 | 0.15 | B1 | C1 | 1.2 | a6 | b3 | 4.0 | 0.25 | 5 | 9 |
| Comparative Example Treatment Agent 01 | — | — | B1 | C1 | 1.2 | a1 + a2 | b3 | 4.0 | 0.25 | 5 | 9 |

TABLE 6-continued

| | Polymer of Carboxylic Acid (A) | | | | | Lubricant (D) | | | | | |
|---|---|---|---|---|---|---|---|---|---|---|---|
| | Component (A) | (A)/(A) + (B) + (C) + (D) | Component (B) | Component (C) | Molar Ratio (B)/(C) | Component a | Component b | a/b | (D)/(A) + (B) + (C) + (D) | (g/m$^2$) | pH |
| Comparative Example Treatment Agent 02 | A6 | 0.15 | B1 | C1 | 1.2 | a1 + a2 | b3 | 4.0 | 0.25 | 5 | 9 |
| Comparative Example Treatment Agent 03 | A1 | 0.5 | B1 | C1 | 1.2 | a1 + a2 | b3 | 4.0 | 0.25 | 5 | 9 |
| Comparative Example Treatment Agent 04 | A1 | 0.15 | — | C1 | 0 | a2 | b3 | 4.0 | 0.25 | 5 | 9 |
| Comparative Example Treatment Agent 05 | A1 | 0.15 | B4 | C1 | 1.2 | a2 | b3 | 4.0 | 0.25 | 5 | 9 |
| Comparative Example Treatment Agent 06 | A1 | 0.15 | B5 | C1 | 1.2 | a2 | b3 | 4.0 | 0.25 | 5 | 9 |
| Comparative Example Treatment Agent 07 | A3 | 0.15 | B1 | — | — | a2 | b3 | 4.0 | 0.25 | 5 | 9 |
| Comparative Example Treatment Agent 08 | A1 | 0.15 | B1 | C1 | 1.2 | — | — | — | — | 5 | 9 |
| Comparative Example Treatment Agent 09 | — | — | B1 | C1 | 1.2 | a1 | b3 | 4.0 | 0.25 | 5 | 9 |
| Comparative Example Treatment Agent 10 | — | — | B1 | C1 | 1.2 | a2 | b3 | 4.0 | 0.25 | 5 | 9 |
| Comparative Example Treatment Agent 11 | — | — | B1 | C1 | 1.2 | a3 | b3 | 4.0 | 0.25 | 5 | 9 |
| Comparative Example Treatment Agent 12 | — | — | B1 | C1 | 1.2 | a1 + a2 | b3 | 4.0 | 0.25 | 5 | 9 |
| Comparative Example Treatment Agent 13 | — | — | B1 | C1 | 1.2 | a4 | b3 | 4.0 | 0.25 | 5 | 9 |
| Comparative Example Treatment Agent 14 | — | — | B1 | C1 | 1.2 | a5 | b3 | 4.0 | 0.25 | 5 | 9 |
| Comparative Example Treatment Agent 15 | A1 | 0.5 | B1 | C1 | 1.2 | a2 | b1 | 4.0 | 0.25 | 5 | 9 |
| Comparative Example Treatment Agent 16 | A1 | 0.5 | B1 | C1 | 1.2 | a2 | b2 | 4.0 | 0.25 | 5 | 9 |
| Comparative Example Treatment Agent 17 | A1 | 0.5 | B1 | C1 | 1.2 | a2 | b4 | 4.0 | 0.25 | 5 | 9 |
| Comparative Example Treatment Agent 18 | A1 | 0.5 | B1 | C1 | 1.2 | a2 | b3 | 4.0 | 0.25 | 5 | 9 |
| Comparative Example Treatment Agent 19 | A1 | 0.01 | B1 | C1 | 1.2 | a2 | b3 | 4.0 | 0.25 | 5 | 9 |
| Comparative Example Treatment Agent 20 | JP 2012-177000 A | | | | | | | | | 5 | |
| Comparative Example Treatment Agent 21 | JP 2012-177000 A | | | | | | | | | 40 | |
| Comparative Example Treatment Agent 22 | Bonder-Lube Treatment | | | | | | | | | 15 | |
| Comparative Example Treatment Agent 23 | WO2002/012420 | | | | | | | | | 5 | |

TABLE 7

| | Evaluation Result | | | | |
|---|---|---|---|---|---|
| | Workability immediately after Treatment | Workability after Moisture Absorption | Seizure Resistance | Scum Generation | Liquid Stability |
| Example Treatment Agent 01 | ◎ | ◎ | ◎ | ◎ | ◎ |
| Example Treatment Agent 02 | Δ | Δ | Δ | ◎ | ◎ |
| Example Treatment Agent 03 | ◎ | ◎ | ◎ | Δ | ◎ |
| Example Treatment Agent 04 | ◎ | ◎ | ◎ | ◎ | ○ |
| Example Treatment Agent 05 | ◎ | ◎ | ◎ | ◎ | ○ |
| Example Treatment Agent 06 | ○ | ○ | ○ | ◎ | ◎ |
| Example Treatment Agent 07 | ◎ | ◎ | ◎ | ◎ | Δ |
| Example Treatment Agent 08 | ○ | ◎ | ◎ | ◎ | ○ |
| Example Treatment Agent 09 | ◎ | ◎ | ◎ | ◎ | ○ |
| Example Treatment Agent 10 | ◎ | ◎ | ◎ | ◎ | Δ |
| Example Treatment Agent 11 | ◎ | ◎ | ◎ | ◎ | ◎ |
| Example Treatment Agent 12 | ○ | ○ | ○ | Δ | ○ |
| Example Treatment Agent 13 | Δ | Δ | Δ | ◎ | ○ |
| Example Treatment Agent 14 | ◎ | Δ | ◎ | ◎ | ○ |
| Example Treatment Agent 15 | ◎ | ○ | ◎ | ◎ | Δ |
| Example Treatment Agent 16 | ◎ | ◎ | ◎ | ○ | ◎ |

TABLE 7-continued

| | Evaluation Result | | | | |
|---|---|---|---|---|---|
| | Workability immediately after Treatment | Workability after Moisture Absorption | Seizure Resistance | Scum Generation | Liquid Stability |
| Example Treatment Agent 17 | ◎ | ◎ | ◎ | ○ | ○ |
| Example Treatment Agent 18 | ◎ | ◎ | ◎ | ○ | ◎ |
| Example Treatment Agent 19 | ◎ | ◎ | ◎ | Δ | Δ |
| Example Treatment Agent 20 | ◎ | ◎ | ◎ | Δ | ○ |
| Example Treatment Agent 21 | ○ | ◎ | ◎ | Δ | ○ |
| Example Treatment Agent 22 | ◎ | ◎ | ◎ | Δ | Δ |
| Example Treatment Agent 23 | ◎ | ◎ | ◎ | Δ | Δ |
| Example Treatment Agent 24 | Δ | Δ | Δ | ○ | ◎ |
| Example Treatment Agent 25 | ○ | ○ | ◎ | ◎ | ◎ |
| Example Treatment Agent 26 | ◎ | ◎ | ◎ | ◎ | Δ |
| Example Treatment Agent 27 | ◎ | ◎ | ◎ | Δ | Δ |
| Example Treatment Agent 28 | ◎ | ◎ | ◎ | Δ | ○ |
| Example Treatment Agent 29 | Δ | Δ | Δ | ◎ | Δ |
| Example Treatment Agent 30 | ◎ | ◎ | ◎ | ◎ | ◎ |
| Example Treatment Agent 31 | ○ | ◎ | ○ | ◎ | Δ |
| Example Treatment Agent 32 | ◎ | ◎ | ◎ | ◎ | Δ |
| Example Treatment Agent 33 | ◎ | ◎ | ◎ | ◎ | Δ |
| Example Treatment Agent 34 | ◎ | ◎ | ○ | Δ | Δ |
| Comparative Example Treatment Agent 01 | X | X | X | ○ | X |
| Comparative Example Treatment Agent 02 | X | X | X | ○ | X |
| Comparative Example Treatment Agent 03 | Δ | Δ | Δ | ○ | X |
| Comparative Example Treatment Agent 04 | X | X | X | X | ○ |
| Comparative Example Treatment Agent 05 | ○ | Δ | ○ | X | Δ |
| Comparative Example Treatment Agent 06 | X | X | X | X | Δ |
| Comparative Example Treatment Agent 07 | ○ | X | Δ | ◎ | ○ |
| Comparative Example Treatment Agent 08 | X | X | X | ◎ | X |
| Comparative Example Treatment Agent 09 | X | X | X | Δ | X |
| Comparative Example Treatment Agent 10 | X | X | X | ◎ | X |
| Comparative Example Treatment Agent 11 | X | X | X | Δ | X |
| Comparative Example Treatment Agent 12 | X | X | X | ○ | X |
| Comparative Example Treatment Agent 13 | X | X | X | Δ | X |
| Comparative Example Treatment Agent 14 | X | X | X | Δ | X |
| Comparative Example Treatment Agent 15 | ◎ | ◎ | ◎ | Δ | X |
| Comparative Example Treatment Agent 16 | ○ | ◎ | ○ | ◎ | X |
| Comparative Example Treatment Agent 17 | ○ | Δ | Δ | ◎ | X |
| Comparative Example Treatment Agent 18 | ◎ | ○ | ◎ | Δ | X |
| Comparative Example Treatment Agent 19 | X | X | X | ◎ | X |
| Comparative Example Treatment Agent 20 JP 2012-177000 A | ○ | Δ | Δ | X | ◎ |
| Comparative Example Treatment Agent 21 JP 2012-177000 A | ○ | X | Δ | X | ◎ |
| Comparative Example Treatment Agent 22 Bonder-Lube Treatment | ◎ | ◎ | ◎ | ○ | NO |
| Comparative Example Treatment Agent 23 WO 2002/012420 | ◎ | X | ◎ | Δ | Δ |

The invention claimed is:

1. A water-based lubricant for plastic working of a metallic material, wherein the water-based lubricant is obtained by adding to a water-based medium:

(A) a polymer and/or a salt thereof containing a carboxylicacid or a derivative thereof as a constituent monomer;

(B) an oxoacid of tungsten, an oxoacid of silicon, or an oxoacid of phosphorus, or a condensate thereof, and/or a salt thereof;

(C) lithium hydroxide; and (D) a lubricating component, and wherein a solid content weight ratio (A)/[(A) (B)+(C)+(D)] is 0.05 to 0.4 and a molar ratio (B)/(C) of the component (B) and the component (C) is 0.3 to 2.7.

2. The water-based lubricant for plastic working of a metallic material according to claim 1, wherein the water-based lubricant has pH of 7 to 12.

3. The water-based lubricant for plastic working of a metallic material according to claim 1, wherein a solid content weight ratio (D)/[(A)+(B)+(C)+(D)] is 0.1 to 0.3.

4. The water-based lubricant for plastic working of a metallic material according to claim 1, wherein the component (D) essentially comprises two components of: (a) a wax and (b) an acidic phosphoric ester-based extreme-pressure agent, and a solid content weight ratio (a)/(b) of the component (a) and the component (b) is 0.2 to 9.0.

5. The water-based lubricant for plastic working of a metallic material according to claim 4, wherein the component (a) has an average particle size of 30 to 1000 nm.

6. The water-based lubricant for plastic working of a metallic material according to claim 4, wherein the component (a) is a polyethylene wax with a melting point of 130 to 170° C.

7. The water-based lubricant for plastic working of a metallic material according to claim 4, wherein the component (b) is a phosphoric ester having an ether linkage and/or a C1 to C20 alkyl group, the phosphoric ester being able to be dispersed and/or dissolved in an alkaline aqueous solution.

8. A method for producing a metallic material with a lubrication film, the method comprising:

bringing the water-based lubricant for plastic working of a metallic material according to claim 1 into contact with the metallic material, and evaporating moisture to form the lubrication film on a surface of the metallic material.

9. A metallic material comprising, on a surface thereof, a lubrication film obtained from the water-based lubricant for plastic working of a metallic material according to claim 1.

10. A method for producing a water-based lubricant for plastic working of a metallic material, the method comprising adding to a water-based medium: (A) a polymer and/or a salt thereof containing a carboxylic acid or a derivative thereof as a constituent monomer; (B) an oxoacid of tungsten, an oxoacid of silicon, or an oxoacid of phosphorus, or a condensate thereof, and/or a salt thereof; (C) lithium hvdroxidea hydroxide of an alkali metal: and (D) a lubricating component (D), wherein a solid content weight ratio (A)/[(A)+(B)+(C)+(D)] is 0.05 to 0.4, and a molar ratio (B)/(C) of the component (B) and the component (C) is 0.3 to 2.7.

11. The method according to claim 10, wherein the water-based lubricant has pH of 7 to 12.

12. The method according to claim 10, wherein the component (C) is a lithium hydroxide.

13. The method according to claim 10, wherein a solid content weight ratio (D)/[(A)+(B)+(C)+(D)] is 0.1 to 0.3.

14. The method according to claim 10, wherein the component (D) essentially comprises two components of: (a) a wax and (b) an acidic phosphoric ester-based extreme-pressure agent, and a solid content weight ratio (a)/(b) of the component (a) and the component (b) is 0.2 to 9.0.

15. The method according to claim 14, wherein the component (a) has an average particle size of 30 to 1000 nm.

16. The method according to claim 14, wherein the component (a) is a polyethylene wax with a melting point of 130 to 170° C.

17. The method according to claim 14, wherein the component (b) is a phosphoric ester having an ether linkage and/or a C1 to C20 alkyl group, the phosphoric ester being able to be dispersed and/or dissolved in an alkaline aqueous solution.

* * * * *